US005706552A

United States Patent [19]

Hsieh

[11] Patent Number: 5,706,552

[45] Date of Patent: Jan. 13, 1998

[54] APPARATUS FOR PREVENTING A MOTOR ROLLING DOOR FROM FALLING

[76] Inventor: Tsung-Wen Hsieh, 1st Fl.No. 15, Sub-lane 3, Lane 217,Chung-Hsiao E. Rd.,Sec. 3, Taipei, Taiwan

[21] Appl. No.: 707,047

[22] Filed: Aug. 30, 1996

[51] Int. Cl.[6] ..... E05F 5/02

[52] U.S. Cl. ..... 16/82; 16/DIG. 10; 16/188; 16/310; 49/322

[58] Field of Search ..... 16/82, 85, DIG. 1, 16/DIG. 7, DIG. 10; 49/322; 160/8, 9, 133, 188, 189, 310

[56] References Cited

U.S. PATENT DOCUMENTS

| | | | |
|---|---|---|---|
| 2,084,677 | 6/1937 | Gerken | 49/322 |
| 4,727,919 | 3/1988 | Kraeutler | 160/310 |
| 5,253,693 | 10/1993 | Marlatt et al. | 160/9 |
| 5,291,686 | 3/1994 | Sears et al. | 49/322 |

FOREIGN PATENT DOCUMENTS

| | | | |
|---|---|---|---|
| 2697570 | 5/1994 | France | 49/322 |

*Primary Examiner*—Chuck Mah
*Attorney, Agent, or Firm*—Bucknam and Archer

[57] ABSTRACT

An apparatus for preventing a motor rolling door from falling includes a wedge shaped sliding plate located at one side of a driven sprocket, which is biased away from the driven sprocket by means of two actuating rods forced by two springs. Two rollers at the outer ends of two actuating rods push against the inner surfaces of the upper and lower stringers of the drive chain to keep the sliding plate away from the driven sprocket. When the drive chain is broken, the two actuating rods extend outward due to the action of the springs, and bias the wedge sliding plate toward the driven sprocket to engage with the driven sprocket, so that the rolling door is prevented from falling by its own weight.

4 Claims, 3 Drawing Sheets

APPARATUS FOR PREVENTING A MOTOR ROLLING DOOR FROM FALLING

FIELD OF THE INVENTION

The present invention relates to an apparatus for preventing a motor rolling door from falling, and more particularly to provide with sliding plate mechanism which prevents the door curtain of slates winding around a barrel from falling by its own weight when the driving chain is broken.

The conventional motor rolling door is operated by a motor to drive a driving sprocket and then drive a driven sprocket through a chain. A rolling barrel integrated with the driven sprocket winds up of the door curtain to open the door and unwinds the door curtain to close the door. However, if the driving chain is inadvertently broken when the door curtain is ascending or descending, the door curtain will fall rapidly by its own weight, and will hurt some persons or damage objects which are just passing by, or will strike the ground with a big sound.

SUMMARY OF THE INVENTION

Therefore, the inventor of the present invention provides an apparatus for preventing a motor rolling door from falling, which comprises a wedge sliding plate and a V-shape position holder for receiving and guiding the sliding plate.

One end of the wedge sliding plate, opposite to the inner end of the driven sprocket without winding the chain, has an arc corresponding to the circle of the sprocket, and forms some protruding pawls on the arc surface to match with the sprocket teeth. At an appropriate position of the other end of the wedge sliding plate, it is pivoted with the ends of the two actuating rods, the outer ends of the two actuating rods are each pivoted with a roller which presses against the inner side of the driving chain. Generally the two rollers are forced by springs such that the two rollers press against the inner sides of the driving chain and the wedge sliding plate has a tendency of keeping away from the driven sprocket. Once the driving chain is broken, the two actuating rods extend outward due to the pulling force of the spring, while the end of the two actuating rods pivoted with the wedge sliding plate swings forward and moves the wedge sliding plate toward the driven sprocket, so that the pawls on the wedge sliding plate are inserted into the teeth recesses of the driven sprocket, and the tendency of continuous moving of the driven sprocket is therefore obstructed, the door curtain wound around the rolling barrel can not roll down due to its own weight. Furthermore, a plug pin mounted on the V-shape position holder drops downward to the top end of the other end of the wedge sliding plate, so that the wedge sliding plate will not move backward due to the weight of the door curtain.

BRIEF DESCRIPTION OF THE DRAWINGS

In order to further understand the above objects, special features and effects of the present invention substantially, embodiments will be described in conjunction with the accompanying drawings as follows.

DETAILED DESCRIPTION OF THE INVENTION

Figure 1:
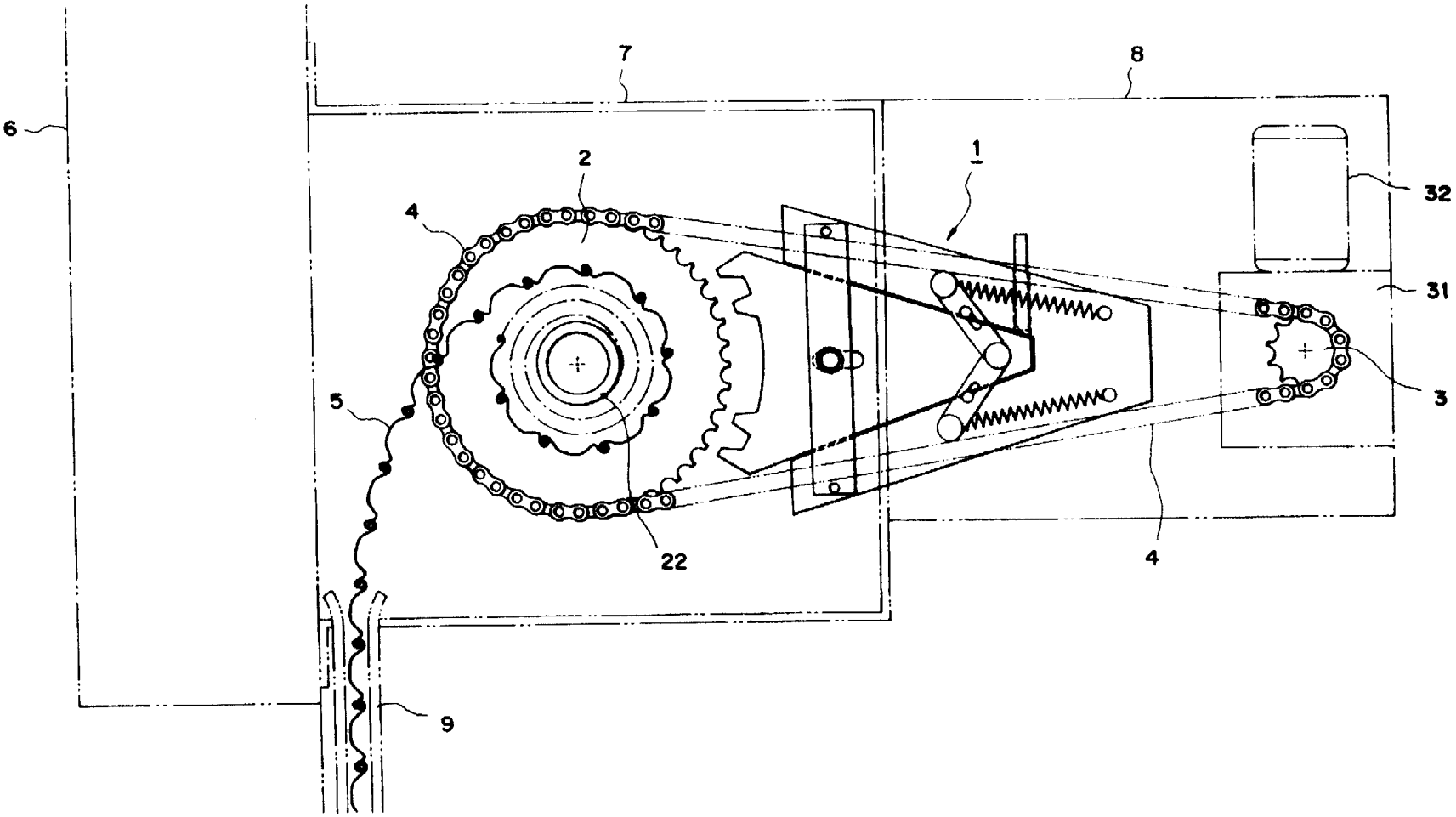
FIG. 1 shows the schematic front view of the embodiment of the present invention, wherein the surrounding structure is shown by dotted lines.
Figure 2:
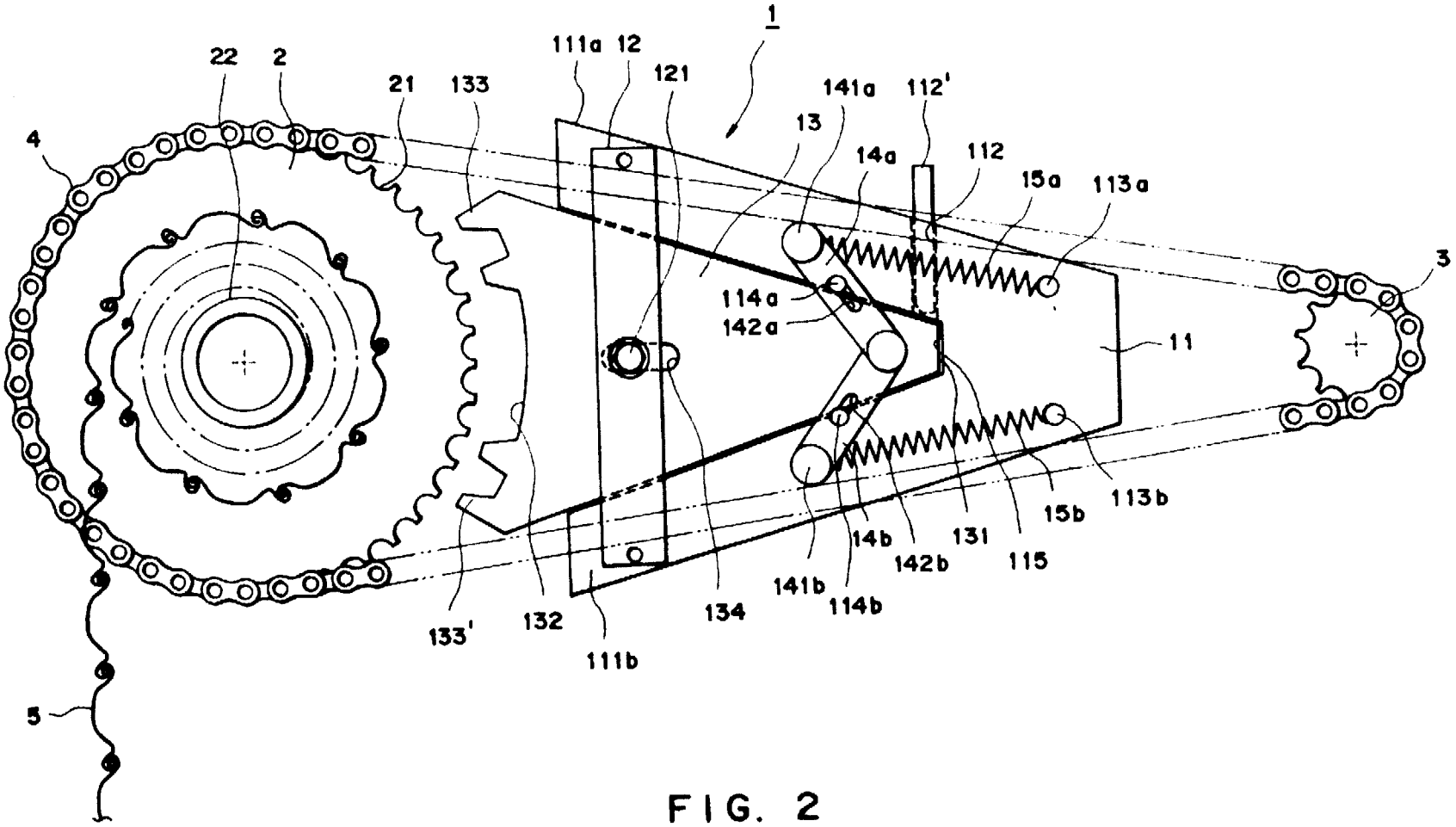
FIG. 2 is a schematic front view showing a normal operating state of a rolling door mounted with the present embodiment with the rolling movement not being obstructed, wherein the surrounding structure which has nothing to do with the explanation are omitted.

Referring to FIG. 1, the structure of the motor rolling door is in general the same as the conventional one, in which a cabinet (7) is provided on top of a door and fixed on a wall surface (6) of a structure to accept a curtain (5) of slates wound around a rolling barrel (22). The end of the curtain (5) of slates is fixed to the rolling barrel (22) which is connected to the driven sprocket (2). The curtain (5) of slates is directed by the guide rails (9) positioned along two sides of the door frame to slide up and down. The driving mechanism which drives the driven sprocket (2) is mounted on a side panel (8) of the cabinet (7). The power of the driving motor (32) is transmitted to the driving sprocket (3) through a speed changing device (31). The sprocket (3) in turn drives the driven sprocket (2) by means of a driving chain (4) to move and roll the curtain (5). These mentioned above are the inherent structures of a motor rolling door. The apparatus (1) of the present invention for preventing a motor rolling door from falling is provided among the two stringers of the chain, the driving sprocket (3) and driven sprocket (2). As shown in FIG. 2, a wedge sliding plate (13) with a triangular shape is located at the right side of the driven sprocket (2). An arc (132) at the left end of the wedge sliding plate corresponds to the addendum circle of the sprocket (2) and is provided with a plurality of protruding pawls (133, 133') at its two ends. The wedge sliding plate (13) is tapered toward the other end and forms a top end (131). Two actuating rods (14*a*, 14*b*) are pivoted at appropriate position to the left of the top end with two rollers (114*a*, 141*b*) being pivoted at the outer ends of the two actuating rods respectively and with two slide slots (142*a*, 142*b*) being formed in the middle.

The wedge sliding plate (13) is accommodated within the V-shape space of a position holder (11). Furthermore, a cover strip (12) is provided between far ends of the two arms (111*a*, 111*b*) of the position holder (11) near to the opening of the V-shape space, with an axle pin (121) being fixed at the center of the strip (12) and being fitted into a long guide slot (134) at the center of the wedge sliding plate (13), for guiding the wedge sliding plate (13) and preventing it from dislodging. Moreover, a plug slot (112) for inserting a plug pin (112') is provided on the upper arm (111*a*) of the position holder (11) near the top end (131) of the sliding plate (13). In addition, two hook rods (113*a*, 113*b*) for anchoring one end of the tension springs (15*a*, 15*b*) are fixed respectively on two arms (111*a*, 111*b*) of the position holder (11), and the other ends of the tension springs (15*a*, 15*b*) are connected respectively with the outer ends of the two actuating rods (14*a*, 14*b*). As shown in FIG. 2, two supporting axles (114*a*, 114*b*) are each fixed on two arms (111*a*, 111*b*) of the position holder and are each inserted into the slide slots (142*a*, 142*b*) of the actuating rods (14*a*, 14*b*) with the actuating rods (14*a*, 14*b*) being suppressed by the upper and lower stringers of the chain. In normal operation, said two actuating rods (14*a*, 14*b*) are tensed by springs (15*a*, 15*b*) so that the outer ends of rollers (141*a*, 141*b*) have tendency to push against the inner side of the driving chain (4) stringers to roll freely, causing the sliding plate (13) to be pulled away from the driven sprocket (2). The running process of the curtain of slates is therefore not obstructed.

Figure 3:
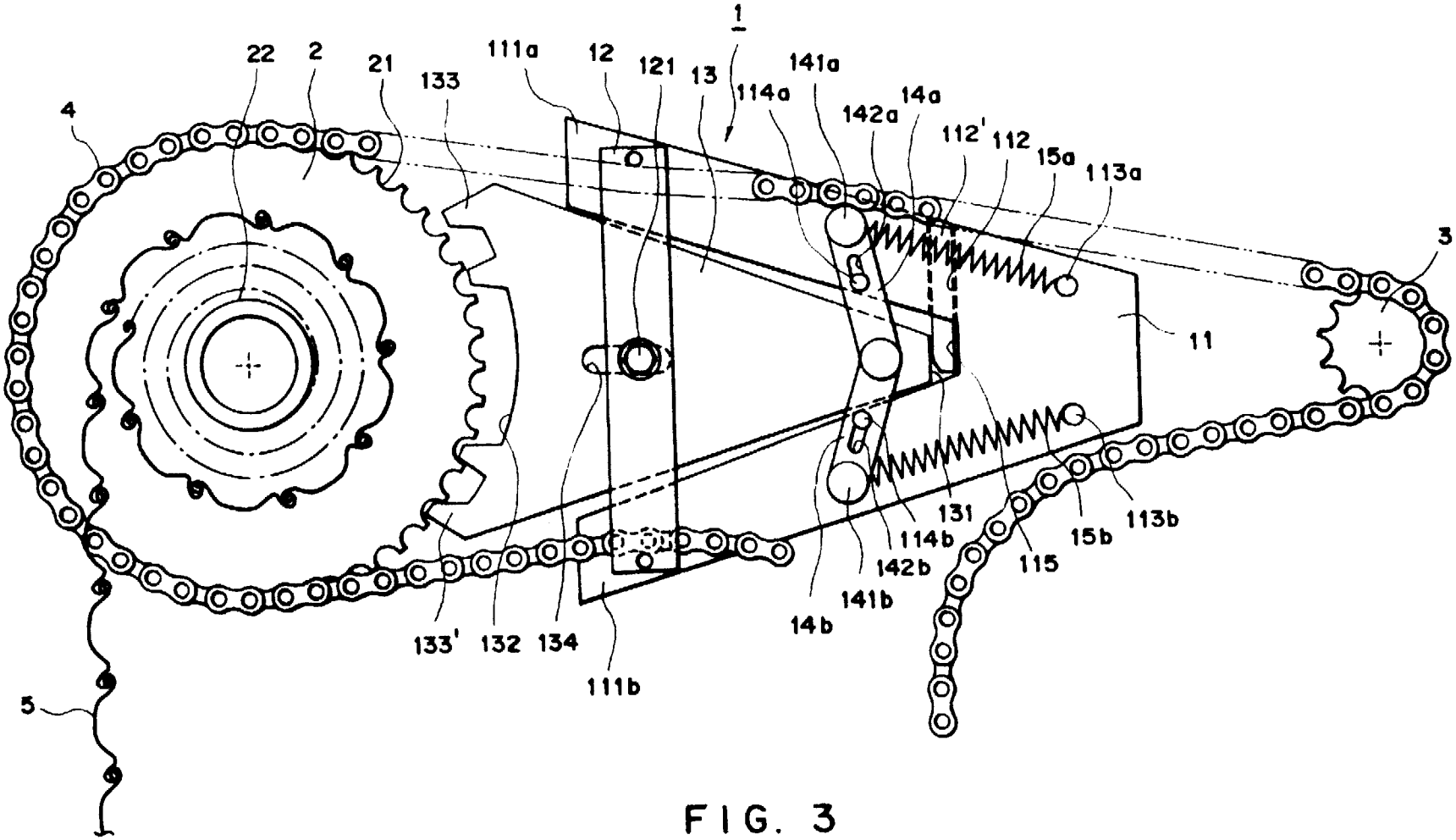
FIG. 3 shows a schematic front view of a wedge sliding plate according to the present invention being inserted into the driven sprocket when the driving chain is broken.

As shown in FIG. 3, once the driving chain (4) is inadvertently broken, the actuating rods (14*a*, 14*b*) pulled by springs (15*a*, 15*b*) will rotate around the supporting axles (114*a*, 114*b*) to the effect that the sliding plate (13) will move toward the driven sprocket (2). Accordingly, the pawls (133, 133') on arc (132) of the sliding plate (13) will insert into and engage with the tooth recess (21) of the driven sprocket (2) to stop the sprocket (2) from turning. While the sliding plate (13) moves forward, the plug pin (112') of the arm (111*a*) mounted on the position holder (11) due to gravity drops automatically between the top end (131) of the sliding plate (13) and the inner bottom (115) of the position holder (11), so that the curtain (5) may not force the sliding plate (13) to move due to its heavy weight.

Because of the above mentioned effects and special features, the present invention can prevent the conventional rolling door from falling, and assure the user of his safety without anxiety.

I claim:

1. Apparatus for preventing a motor rolling door from falling, said apparatus being positioned within a space defined by a driving sprocket, a driven sprocket and upper and lower stringers of a drive chain of the motor rolling door assembly, said apparatus comprising:

a sliding plate having a first end facing the driven sprocket, said first end having an arcuate shape corresponding to the shape of the driven sprocket and a plurality of protruding pawls arranged along the arcuate shaped first end of the sliding plate, and an elongated guide slot provided at the center of the sliding plate having an axle pin therein to limit movement of the sliding plate sliding toward the driven sprocket;

a position holder for accommodating a second end of the sliding plate opposite said first end having an upper arm and a lower arm, and two actuating rods, a first end of each actuating rod being pivotably mounted on said sliding plate, a slide slot provided centrally on each actuating rod having an axle pin extending therein from said position holder;

two springs, each corresponding to one of the two actuating rods having a first end anchored on the position holder and a second end connected to a second end of the respective actuating rod, said two springs biasing the second end of one of said two actuating rods against an inner side of the upper stringer of the drive chain and the second end of the other of said two actuating rods against an inner side of the lower stringer of the drive chain;

whereby, under normal operation the sliding plate is biased away from the driven sprocket by the springs acting through the two actuating rods and when the drive chain is broken, the sliding plate is biased toward the driven sprocket by the springs acting on said sliding plate through the two actuating rods so that the protruding pawls of the sliding plate engage with the driven sprocket.

2. The apparatus for preventing a motor rolling door from falling according to claim 1, wherein the position holder has a V-shape and the sliding plate has a wedge shape.

3. The apparatus for preventing a motor rolling door from falling according to claim 1, further comprising a roller pivoted on the second end of each of said two actuating rods to press against the upper and lower stringers of the drive chain.

4. The apparatus for preventing a motor rolling door from falling according to claim 1, further comprising a plug slot on the upper arm of the position holder directed toward the second end of the sliding plate and a plug pin inserted in said plug slot, so that when said sliding plate is biased toward said driven sprocket said plug pin drops due to gravity to block the second end of said sliding plate and prevent movement of said sliding plate away from said driven sprocket.

* * * * *